United States Patent [19]

Germanaz et al.

[11] Patent Number: 4,892,630

[45] Date of Patent: Jan. 9, 1990

[54] PROCESS FOR THE PASSIVATING ANODIZATION OF COPPER IN A MEDIUM OF MOLTEN FLUORIDES, AND USE FOR THE PROTECTION OF COPPER PARTS OF FLUORINE ELECTROLYSERS

[75] Inventors: Patrick Germanaz, Aix en Provence; Sylvie Lamirault, Voiron; Gerard Picard, Fontenay Sous Bois, all of France

[73] Assignee: Comurhex Societe Pour la Conversion de l'Ranium en Metal et Hexafluorure, Courbevoie, France

[21] Appl. No.: 343,145

[22] PCT Filed: Jun. 23, 1988

[86] PCT No.: PCT/FR88/00334

§ 371 Date: Feb. 23, 1989

§ 102(e) Date: Feb. 23, 1989

[87] PCT Pub. No.: WO88/10328

PCT Pub. Date: Dec. 29, 1988

[30] Foreign Application Priority Data

Jun. 26, 1987 [FR] France ..... 87 09574

[51] Int. Cl.[4] ..... C25D 11/02

[52] U.S. Cl. ..... 204/59.5

[58] Field of Search ..... 204/58.5

[56] References Cited

PUBLICATIONS

Electrodeposition and Surface Treatment, vol. 1, No. 3, 1972/1973 pp. 253–265.

Chemical Abstracts, vol. 91; No. 2, 1979, p. 413, 11360x.

*Primary Examiner*—T. M. Tufariello

*Attorney, Agent, or Firm*—Dennison, Meserole, Pollack & Scheiner

[57] ABSTRACT

A process for producing a strong, adherent protective layer on copper parts, with a high rate of covering of the substrate, by passivating anodization, characterized in that the copper parts are immersed in a liquid KF, 2HF bath and subjected to anodic current of low surface-related density which is less than 0.1 A/dm$^2$, which current may be continuous or intermittent.

13 Claims, 1 Drawing Sheet

Figure 1:
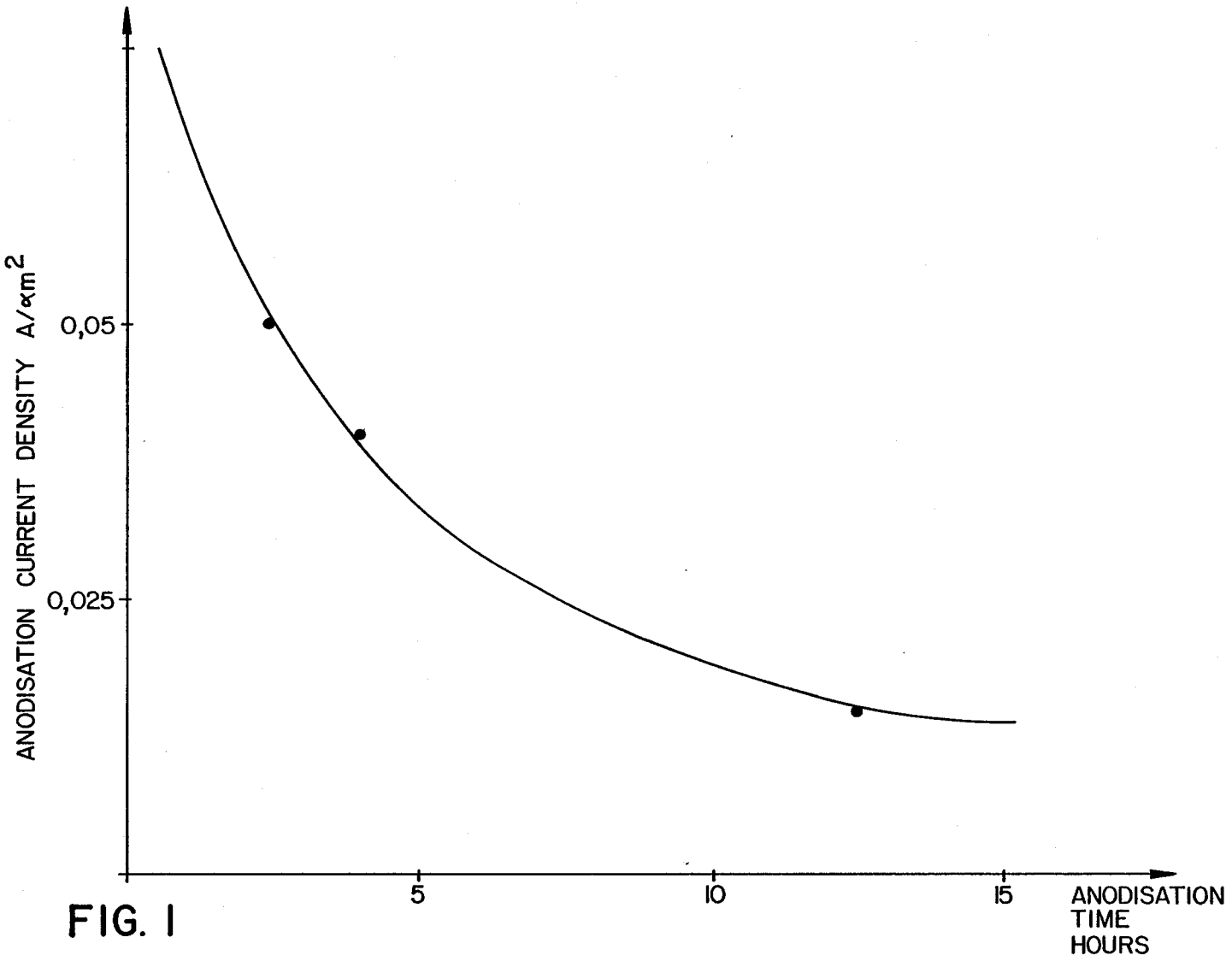

PROCESS FOR THE PASSIVATING ANODIZATION OF COPPER IN A MEDIUM OF MOLTEN FLUORIDES, AND USE FOR THE PROTECTION OF COPPER PARTS OF FLUORINE ELECTROLYSERS

TECHNICAL FIELD

The present invention concerns a process for the passivating anodisation of copper parts in a medium of molten fluorides forming an adherent protective layer with a high covering rate; the process can be used in particular but not exclusively for the protection of the copper parts used in electrolysers for the production of fluorine.

STATE OF THE ART

The process for producing fluorine by electrolysis uses a bath of molten fluorides, which is generally a mixture of hydrogen fluoride and fluorides of alkali metals and/or ammonium. The anodes of carbonaceous material are immersed vertically in the bath and are supplied with electrical current by current supply members which are usually of copper. The copper-anode junction which represents a weak point usually occurs at the top of the anode, in which case the copper current supply member and the copper-anode junction are partially immersed in the bath and are subjected to the action of the bath and the fluorine bubbles which are given off at the anode. Passivation of the copper occurs on the one hand by virtue of immersion in the bath of liquid fluorides and on the other hand due to anodisation when the electrolysis cell is put under voltage, but the properties of the layer obtained are highly unsatisfactory for providing effective protection for the copper. The copper is thus dissolved, resulting in a slow, regular deterioration in the copper-anode contact, which requires the electrolysis cell to be stopped and renovated, in particular requiring the current supply members to be restored and the anode changed. That renovation operation is effected approximately once per year.

The copper-anode junction may also advantageously be made at the bottom. In that case the copper current supply members pass through the total thickness of the bath before being connected to the base portions of the anodes. It is then necessary for them to be insulated, to prevent dissolution thereof; it is possible for example to provide sheaths which are capable of resisting the bath. An arrangement of that kind is described in SU-patent No. 193 454 which describes sheathing for the current supply members which is effected by means of magnesium, and protection for the copper-anode contacts by means of a chemically inert insulating agent (fluorinated hydrocarbon). The use of such protection arrangements is a delicate matter and they involve the use of products which give rise to problems.

However, the document 'Electrodeposition and surface treatment' I (3)—1973, pages 256–265 (Battelle) discloses a treatment for the anodic passivation of copper in a liquid KF-HF bath. To form the passivating layer, that document describes a constant anodic passivation current of at least 0.4 A/dm$^2$ in an equimolecular KF-HF bath at 245° C., the time for which that current is applied decreasing in proportion to an increasing current; for a passivation period of greater than about 60 minutes, it is noted that the value of the passivation current is still between 0.4 and 0.45 A/dm$^2$ (FIG. 2), in other words 0.4 A/dm$^2$ represents a minimum asymptotic value of the passivation current.

That document also discloses anodic passivation of the copper in an anhydrous HF bath at 20° C., in which case the minimum asymptotic value of the anodisation current is about 0.15 A/dm$^2$.

The difficulty involved in significantly reducing corrosion of the copper and preventing deterioration in the copper-anode contacts in liquid KF-x HF baths (throughout the description the expression KF-x HF will means a mixture in which the number of moles of HF is exclusively equal to or close to 2), for the electrolytic production of fluorine, constitutes at the present time a limit on improving and developing fluorine electrolysers with higher levels of performance.

OBJECT OF THE INVENTION

Thus the applicants continued their research, the main object of which is to provide for durable and effective passivation of copper in a bath of liquid fluorides by means of a process which is simple to carry into effect. In particular the passivation operation is to provide durable and effective protection for the copper under the conditions encountered in the electrolytic production of fluorine; in particular it must withstand the action of the electrolysis KF, xHF baths, the fluorine produced and the electrolysis current.

Another object is the controlled production or manufacture of a layer for protecting copper in a medium of molten fluorides, which is fluid-tight and which has a high level of adhesion to the copper substrate and a high rate of covering the substrate.

Another object is to produce an electrically insulating layer.

A further object is to produce a layer which is thin while, by virtue of the strong cohesion of the particles which constitute the layer, it has good mechanical characteristics, in particular resistance to abrasion, wear, impacts... .

A further object of the invention is to use an electrochemical process which makes it possible to effect the passivation operation in tanks and on the production site, opening the production of such tanks.

Another object is to avoid slow dissolution of the copper and degradation of the copper-anode junctions during electrolysis of liquid fluoride baths and in particular the KF, xHF bath.

DESCRIPTION OF THE INVENTION

The invention is a process for the passivating anodisation of copper parts in a liquid KF, xHF medium (x close to 2) which makes it possible to produce a mechanically and electrically strong adherent protective layer with a high rate of covering of the copper substrate, characterised in that said copper parts, once immersed in the liquid KF, xHF bath, are subjected to an anodic current of low surface-related density, calculated with respect to the immersed copper surface area, of less than 0.1 A/dm$^2$. That treatment is applied for a variable period of time which is always greater than a limit value which is dependent on the value of the anodic current density.

The bath is formed by a liquid KF, xHF mixture in which the amount of HF is preferably between 38 and 42.5%; that mixture is usually employed as a bath for the electrolytic production of fluorine.

The bath is to be liquid; it is advantageous to operate under conditions (temperature and concentration) such that the vapour pressure of HF does not exceed 50 mm of mercury, or that there is not more than 7% (by weight) of HF which is entrained by the gases. Thus it is advantageous to operate at a temperature of between 85 and 105° C.

For that type of bath which is used in the electrolytic production of fluorine, the applicants researched a process for the passivation of copper by anodisation, which process is to be such that the protective layer formed is resistant both to the action of the bath which is acid (presence of 2 HF) and the action of the fluorine which is given off in the course of the electrolysis operation. Such a bath is essentially different from those described by Battelle which are (i) one which is very basic, taking account of the presence of a single HF molecule which is bonded to the KF molecule, dissociation giving the species $F^-$and $HF_2^-$(ii) the other being free of KF. In such baths the activity of the constituents is different from that encountered is the baths used in the invention and the temperatures described are also very different therein.

It follows that Battelle describes anodisation current strengths which are higher than a floor value (for example 0.4 A/dm$^2$) which is itself greatly higher than the maximum strength prescribed by the applicants.

Accordingly the conditions for formation (in particular nucleation and growth...) of the passivating layer, as described by Battelle, are very different and produce a layer with properties such as homogeneity of density of adhesion, which are also highly different. Those operating conditions thus cannot be used to provide the conditions for the formation of a protective layer in a KF, xHF medium, which complies with the applicants' requirements, which layer must be capable of withstanding the bath, the fluorine which is given off and the electrical conditions in the electrolysis operation, and it also to be adherent, compact and solid in the course of time.

In accordance with the invention a dc voltage is applied between the copper part to be protected and a cathode of any conductive material, for example steel, which is also immersed in the bath. That voltage and also the shape, positioning, spacing etc of the cathode are such that the current density at all points of the surface to be protected is uniform and is maintained at a low value.

The low current density applied to the surface to be protected may be maintained at a constant value in dependence on time and throughout the entire duration of the treatment, in which case the anodisation treatment is referred to as being a constant-mode treatment; it may also be of a variable value in which case the treatment is referred to as a variable-mode treatment.

It is an interesting proposition to use the lowest possible levels of current density; in fact, for low values of current density, the substrate covering rate and the compactness of the protective layer are better. Moreover the quality of the protective layer produced by the anodic treatment improves in proportion to increasing length of the period of treatment.

However, with excessively low levels of current density, the duration of the treatment increases exponentially and becomes prohibitive; likewise for a given level of current density the quality of the protective layer formed remains practically the same when the duration of the treatment is prolonged to an exaggerated extent. Thus the current density must generally be less than 0.1 A/dm$^2$ but preferably less than 0.5 A/dm$^2$ and more particularly less than 0.025 A/dm$^2$. As regards the duration of the treatment, practically but not limitatively, it does not exceed 20 hours and preferably 15 hours and consequently the process avoids using, in a constant-mode treatment, a current density which is less than 0.01 A/dm$^2$.

For levels of current density at the upper limit of 0.1 A/dm$^2$, the treatment time is generally more/than 0.5 hour but for levels of current density of the order of 0.05 A/dm$^2$, the usual practice is to employ treatment times of between 2 and 4 hours.

The curve shown in FIG. 1 gives an illustration of a possible relationship between the current density (shown in ordinates) and the treatment time (shown in abscissae) for producing the same protective layer when the current density (or strength) is kept constant in the course of the treatment, for a bath KF, xHF, containing 40.5% by weight of HF.

In an advantageous embodiment of the invention (variable mode), the current density applied is variable in dependence on time, while remaining within the above-described limits. In particular it is possible to alternate sequences in which voltage is applied (current density not zero) and relaxation sequences (voltage and current zero); the values of current density used during each anodisation sequence may be constant or variable, and they may be the same or different from one sequence to another; each anodisation sequence may be of the same or a different duration; each relaxation sequence may be of the same or a different duration and such durations are independent of the durations of the anodisation sequences. In that case certain anodisation sequences may have current densities of less than 0.01 A/dm$^2$.

This variable-mode embodiment of the invention makes it possible to reduce the total duration of the treatment in comparison with the constant-mode embodiment and also makes it possible to reduce in each anodisation sequence the value of the current density used.

The process according to the invention makes it possible to provide for durable and effective passivation of copper in baths of molten fluorides by virtue of the production of a protective layer which is formed essentially by a mixed fluoride of copper, which is found to have a high rate of covering for the copper substrate, a high level of compactness in respect of the arrangement of elementary particles, a high level of adhesion and substantial resistivity. That layer thus prevents anodic dissolution of the copper. Those properties are increasingly marked in proportion to decreasing current density and increasing treatment time.

Those properties are indicated by measuring the leakage current passing through the protective layer formed, by virtue of a given voltage applied across the layer. Generally it is measured, with the part being immersed in a conductive bath, for example the passivation bath, by applying a dc voltage between the part and another immersed electrode.

Thus a copper part passivated in accordance with the prior art by simply being dipped in a liquid KF, xHF bath, has a leakage current of 25 mA/dm$^2$ under a voltage of 5 V. In contrast a part passivated by the process according to the invention in the same type of bath has a leakage current which does not exceed 5 mA/dm$^2$ under a voltage of 10 V and usually close to or less than 3 mA/dm$^2$ under a voltage of 10 V.

The protective layer is also mechanically strong while in addition it is very thin so that it does not significantly alter the dimensions or the geometry of the passivated parts.

The process according to the invention can be used for the passivation of all kinds of copper parts which are subsequently to be used in a medium of molten fluorides or in aqueous solution.

The copper parts passivated by means of the process according to the invention provide very good resistance to chemical corrosion in all media containing fluorides, in particular baths of molten fluorides and more especially baths containing at least hydrogen fluoride and a fluoride of alkali metals or ammonium. Because the protective layer has good adhesion and markedly improved mechanical properties, it is possible to use the passivated parts in a calm or agitated, homogeneous or heterogeneous medium.

However the process finds its particular area of use in the passivation and protection of copper parts, in particular bars for feeding current to the electrodes which are installed in fluorine electrolysers using liquid KF, xHF baths as the electrolyte, by virtue of the improved quality of the layer formed which has good resistance to the bath, the fluorine and the current. The fact that those parts have voltage applied thereto does not affect their resistance to corrosion.

It is possible to measure the amount of wear of parts which are passivated in accordance with the process of the invention by immersing them in the molten bath and subjecting them to an anodic voltage for a week, as mentioned above, and weighing the part before and after the treatment. The following results were thus noted on cylindrical discs of a diameter of 35 mm, with rounded edges, in a bath KF, xHF:

for a part passivated by simply being dipped in accordance with the prior art and subjected to an anodic voltage of 5 V, the leakage current is 25 mA/dm$^2$, the weight loss corresponding to an amount of wear of 3mm/year;

for a part passivated in accordance with the process of the invention subjected to an anodic voltage of 10 V:

if the leakage current is 3 mA/dm$^2$, the weight loss corresponding to an amount of wear of 0.35 mm/year, if the leakage current is 3.5 mA/dm$^2$, the corresponding wear is 0.4 mm/year, if the leakage current is 5 mA/dm$^2$, the corresponding wear is less than 0.6 mm/year.

The very good quality of the passivation effect produced makes it possible, when used for the electrolysis of fluorine, to increase the service life of the copper parts to at least 5 years and to use new electrolysis cell technologies, in particular supplying the anodes at the bottom, having regard to the fact that copper parts passivated in accordance with the process can be immersed and put under voltage without problem.

EXAMPLES

The following examples provide non-limitative illustration of different operating conditions of the process according to the invention.

EXAMPLE 1

Passivation by means of a current of constant strength.

A disc of copper of type Cu a 1 of a diameter of 35 mm and with a total surface area of 0.2 dm$^2$ is subjected to an anodic voltage such that the strength of the current is maintained constant at a value of 3 mA (0.015 A/dm$^2$) for a period of 12 hours 30 minutes, with a cathode of steel which is identical to the anode, in a bath KF, xHF containing 40.5% by weight of HF, at 95° C.

After treatment the leakage current observed with a voltage of 10 volts is 3.5 mA/dm$^2$.

EXAMPLE 2

Passivation in stages of decreasing anodisation current density, alternately with relaxation periods (variable mode).

The copper disc and the bath are identical to those of Example 1. The treatment procedure is as follows:

anodic voltage such that the current strength is maintained at a value of 2.8 mA (0.014 A/dm$^2$) for a period of 3 hours, voltage zero (relaxation) for 30 minutes, anodic voltage such that the current strength is maintained at a value of 2.8 mA (0.014 A/dm$^2$) for a period of 3 hours, relaxation for a period of 30 minutes, and anodic voltage such that the current strength is maintained at a value of 1 mA ( 0.005 A/dm$^2$) for a period of 3 hours.

After treatment the leakage current observed with a voltage of 10 V is only 2.0 mA/dm$^2$ while the treatment time is only 10 hours.

EXAMPLE 3

Passivation by means of a current of constant strength in a bath of another composition. The disc used is identical to that used in Example 1. The bath is a HF-KF mixture containing 38% by weight of HF at 85° C. The copper part is passivated under an anodic current of 3 mA (that is to say 0.015 A/dm$^2$) for about 3 hours 30 minutes.

After treatment the leakage current observed with a voltage of 10 V is 1 m/dm$^2$, which is revealed by an amount of corrosion of 0.12 mm per year.

EXAMPLE 4

Passivation by means of a current of constant strength which is applied for an insufficient time.

This example uses a copper disc, a bath and a temperature which are identical to those of Example 1. The current strength is maintained at a value of 0.08 A/dm$^2$ for a period of 0.5 hour.

After treatment the leakage current observed is 13 mA/dm$^2$, corresponding to a mean amount of wear of 1.5 mm/year. That low value is to be compared to the amount of wear of 3 mm/year for a part which is passivated by simple dipping. However it results in a reduction in corrosion of the copper, which is still inadequate from the point of view of the man skilled in the art.

We claim:

1. A process for the passivating anodisation of copper parts in a liquid KF-xHF medium, where x is about 2, which makes it possible to produce a mechanically and electrically strong, adherent protective layer, with a high rate of covering of the copper substrate, comprising immersing said parts in the liquid KF-xHF bath they and subjecting said immersed parts to an anodic current of a surface-related density, calculated with respect to the immersed surface of copper to be treated, of lower than 0.1 A/dm$^2$.

2. A process according to claim 1 wherein the surface-related current density is preferably lower than 0.05 $A/dm^2$.

3. A process according to claim 1 or 2, wherein the duraction of the treatment with a low current density is higher than a limit value.

4. A process according to claim 1 or 2, wherein the treatment time is longer than 0.5 hour.

5. A process according to claim 1, wherein the anodic current density is maintained at a constant value during the treatment time.

6. A process according to claim 1 or 2 wherein the anodic current density is of a variable value in the course of the treatment.

7. A process according to claim 6 comprising alternating anodisation sequences with a current density which is not zero and relxation sequences with a zero current density.

8. A layer for protecting copper parts, produced by the process according to claim 1 or 2, consisting essentially of a mixed compact copper fluoride having a high rate of covering of the substrate.

9. A layer for protecting copper parts, produced by the process according to claim 1 or 2, wherein the leakage current measured across said layer under a voltage of 10 V is less than 5$mA/dm^2$.

10. A process according to claim 6, wherein the value of the current density decreases from one sequence to the next.

11. A process according to claim 4, wherein the anodic current density is maintained at a constant value during the treatment time.

12. A process according to claim 4, wherein said treatment time is between 2 and 4 hours.

13. A layer for protecting copper parts according to claim 9, wherein said leakage is less than 3 $mA/dm^2$.

* * * * *

UNITED STATES PATENT AND TRADEMARK OFFICE

CERTIFICATE OF CORRECTION

PATENT NO. : 4,892,630

DATED : January 9, 1990

INVENTOR(S) : Patrick Germanaz et al

It is certified that error appears in the above-identified patent and that said Letters Patent is hereby corrected as shown below:

ON THE TITLE PAGE, ITEM [73]

The name of the Assignee should be:

"Comurhex Societe Pour la Conversion de l'Uranium en Metal et Hexafluorure"

Signed and Sealed this

Sixteenth Day of April, 1991

*Attest:*

HARRY F. MANBECK, JR.

*Attesting Officer*

*Commissioner of Patents and Trademarks*